United States Patent [19]

Lane

[11] Patent Number: 4,645,514

[45] Date of Patent: Feb. 24, 1987

[54] COAL-AQUEOUS SLURRY

[75] Inventor: Robert H. Lane, Tustin, Calif.

[73] Assignee: Oxce Fuel Company, Windsor, Conn.

[21] Appl. No.: 515,829

[22] Filed: Jul. 21, 1983

[51] Int. Cl.[4] ..... C10L 1/32

[52] U.S. Cl. ..... 44/51; 252/351; 406/47; 406/49; 406/195; 406/197

[58] Field of Search ..... 44/51; 252/351; 406/47, 406/49, 195, 197

[56] References Cited

U.S. PATENT DOCUMENTS 3,069,361 12/1962 Cogswell ..... 252/351
4,242,098 12/1980 Braun ..... 44/51
4,358,293 11/1982 Mark ..... 44/51

FOREIGN PATENT DOCUMENTS 57-0192493 11/1982 Japan ..... 44/51

*Primary Examiner*—William R. Dixon, Jr.
*Assistant Examiner*—Margaret B. Medley
*Attorney, Agent, or Firm*—Walter A. Hackler

[57] ABSTRACT

Coal-aqueous slurries having improved shear stability and lower viscosity are described. The use of a plurality surfactants each having hydrophilic portion with each surfactant hydrophilic portion having a different molecular weight are utilized in sufficient amounts to wet and disperse particulate coal and water. When two surfactants are utilized, coal-aqueous mixtures may be formulated having up to or over 70% by weight coal when the first surfactant has a hydrophilic portion comprising a relatively large number of ethylene oxide units and the second surfactant has hydrophilic portion comprising a relatively small number of ethylene oxide units.

29 Claims, No Drawings

COAL-AQUEOUS SLURRY

The present invention is directed to dispersions of carbonaceous material in water. More particularly, the present invention is related to a dispersion of coal and water.

BACKGROUND OF THE INVENTION

It is well known that coal is the most abundant energy source in the United States. Many attempts have been made to extend the use of coal as an industrial energy source in the United States by forming coal-water and coal-oil slurries, or mixtures.

The rationale behind the formation of such slurries are numerous. First, slurries are more easily and safely transported than dry coal, the later being known to form hazardous coal dust. Additionally, these slurries are more easily stored and less subject to the possibility of explosion by spontaneous ignition. Further, the fluid nature of the slurries enables burning in existing combustion equipment that has previously been designed for the burning of fuel oil. This last advantage is significant from a cost standpoint since substantially less retrofit of combustion equipment is necessary to change from the burning of fuel oil to the burning of coal slurries, than to rework the equipment to burn dry coal.

Significant problems have been encountered in dispersing coal in water to form coal slurries, or mixtures, suitable for use as a combustion source. First, it is well known that coal slurries do not have stability toward sedimentation, that is, they tend to settle when they are stored.

Numerous methods have been utilized to prevent settling or stabilize the coal slurry. For example, it is well know that more finely ground coal is easier to disperse in water and once a slurry is formed the coal tends to stay suspended for longer periods of time. Unfortunately, the extensive grinding requires a large amount of mechanical energy which significantly increases the cost of coal water slurries, making them less economically attractive.

It is also apparent that the usefulness of the coal aqueous slurry as a combustion source depends on the amount of coal suspended or dispersed in the water. Water may be a significant factor in the cost of transportation and processing operations hence, the less water transported the greater the volume of coal that can be utilized per unit volume of coal aqueous slurry. In addition, the greater percentage of water, the more difficulty one has in burning the resulting mixture.

Many attempts have been made to form stable dispersions of coal and water through the use of additives. For example, in U.S. Pat. No. 4,242,098 issued to Braun al, it was found that small amounts of certain water-soluble polymers, when added to aqueous coal slurries, permitted the transportation of coal slurries with much higher weight percent solids content than was heretofore possible. The water soluble polymers discribed therein included poly (ethylene oxide), particularly hydrolyzed poly (acrylamide), hydroxyethyl cellulose, among others. Unfortunately, a significant amount of these additives must be utilized to provide a slurry with an exceptable shear stability and viscosity, thus increasing the cost of the resulting coal water slurry.

A more recent U.S. patent to Mark, namely U.S. Pat. No. 4,358,293, utilizes polyalkyleneoxide nonionic surfactants for forming coal-aqueous mixtures having high coal solids concentrations. This reference teaches that polyalkyleneoxide nonionic surfactants of high molecular weight having a hydrophobic portion and a hydrophilic portion enable the dispersing of coal in water to the extent of having coal solid concentrations of about 70 percent by weight or higher when the hydrophilic portion is comprised of at least about 100 ethylene oxide repeating units.

As recognized by Mark in U.S. Pat. No. 4,358,293, it is desireable to provide coal in aqueous mixture form, when only a small amount of additive materials is needed to disperse the coal to high solid concentrations. Attempts to minimize the amounts of additive utilized are directly associated with the overall cost of providing coal aqueous slurries on a commercial basis.

The present invention is directed to the utilization of surfactants such as those used by Mark in a manner enabling the use of less surfactants to stabilize coal aqueous slurries having a coal content of 70 percent or better, and further to provide coal aqueous slurries having lower viscosity and higher shear stability. Lower viscosity relates to less transportation costs by way of pumping, and greater shear stability relates to the resistance of the slurry to thickening during extended periods under shear, such as occurs during pumping.

SUMMARY OF THE INVENTION

It has been found that a coal aqueous slurry having improved shear stability and lower viscosity consists essentially of particulate coal, water, and a plurality of surfactants, each having a hydrophilic portion with each surfactant hydrophilic portion having a different molecular weight. The plurality of surfactants are present in amounts sufficient to wet and disperse the particulate coal in water.

Further, it has been found that two surfactants may be used, with the first surfactant having a hydrophilic portion comprising a relatively large number of ethyleneoxide units and the second surfactant having a hydrophilic portion comprising a relatively small number of ethyleneoxide units.

Generally, the surfactants consist of a hydrophobe to which is polymerized an average molar ratio of monomeric ethyleneoxide units. Although an average molecular weight is thus obtained, in actuality there are present a range of molecular weights distributed according to the Poisson distribution. It is believed that species of low to moderate molecular weight will adsorb to, and aid wetting of, the surface of coal particles in a slurry, whereas species of higher molecular weight will function to disperse coal particles.

Hence in using a single surfactant of stated average molecular weight, such as used in Mark, U.S. Pat. No. 4,358,293, there is little if any control over the relative amounts of low, moderate and high molecular weights species present, due to the natural laws governing the distribution of polymer chain links that occurs during polymerization.

According to the present invention, blending low molecular weight surfactants with higher molecular weight surfactants, enables alteration of the relative distribution of molecular weights to optimize wetting and dispersal. In this manner it has been discovered that not only are lower viscosities obtainable, but improved shear stability also occures. In addition, the total weight of blended surfactants in the resulting coal aqueous slurry may be less than the amount required if a single surfactant is used.

DETAILED DESCRIPTION

The coal aqueous slurries of the present invention are comprised of coal as the dispersed solid material, water as the carrier medium and a polyalkyleneoxide nonionic surfactant as described herein as the dispersant. In addition small amounts of xanthan gum as a stabilizer, a biocide and an antifoam may be utilized.

Although nonionic surfactants are described herein as examples of the present invention, ionic surfactants may be used, particularly of the alkyl polyether ethoxylated sulfate, ethoxylated alcohol sulfate and alkyl aryl ethoxylated sulfate types.

Suitable polyalkyleneoxide nonionic surfactants for use in the present invention are commercially available glycol ethers of the following general formula; $R—O—(CH_2CH_2O)_n—CH_2—CH_2—OH$ wherein R is substituted or unsubstituted alkyl of from 1 to 18 carbon atoms, substituted or unsubstituted aryl, or an amino group and n is the number of ethylene oxide repeating units and varies from about 40 to about 150. The preferred surfactant is nonylphenoxy polyethyleneoxide having about 100 ethylene units (hereinafter designated as NP-100) when blended with a nonylphenoxy polyethyleneoxide surfactants having a hydrophilic-lipophilic balance (HLB) of about 8 to about 18, that is, having lower numbers of ethylene oxide units, for example, about 4 to about 40.

Table 1 summarizes the effects of using blended surfactants on the minimum viscosity and shear stability of the resulting coal-aqueous slurries. As is apparant from Table 1, NP-10 provided the best improvement and the optimum level of NP-10 was about 0.1 percent by weight. A review of the results in Table 1 shows that 0.05 percent by weight of NP 10 results in significantly less shear stability whereas 0.15 percent showed no improvement in shear stability over the 0.1 percent case. All of the slurries shown in Table 1 included 70 percent by weight ELK CREEK utility grind coal, 0.1% xanthan gum as a stabilizer, 0.1 percent Proxel as a biocide and 0.1% foamaster R (Diamond Shamrock) as a defoamer. As also shown in Table 1 the molecular weight of the polyalkeneoxide nonionic surfactant having 10 ethylene oxide units is about 682 and the molecular weight of the polyalkeneoxide nonionic surfactant having 100 ethylene oxide units is about 4680.

Suitable coals for use in the present invention include anthracite, high- and low-volatile bituminous, subbituminous, mine tailings and fines. The art will appreciate the enhanced value of a fuel prepared from beneficiated coal since the product will contain less ash and will thus be cleaner burning. Coals beneficiated by mechanical and/or chemical means, as well as unbeneficiated coals, are suitable for use in this invention.

The following are specific examples and preferred embodiments of the present invention. There is no intention that the claims be limited thereto, since many variations of such examples embodiments are within the skill of the art.

TABLE 1

| W + % NP-100 | Type (amount) of other additive | Minimum viscosity (Brookfield D Spindle, 30 RPM) | Shear Stability (hours) |
|---|---|---|---|
| 0.3% | — | 5700 cp | 0.5 |
| 0.4% | — | 3100 cp | 2.0 |
| 0.3% | Calgon (100 ppm) | 5600 cp | 0.5 |
| 0.3% | NP40 (0.1%) | 2600 cp | 3.0 |
| 0.3% | NP10 (0.05%) | 3500 cp | 1.5 |
| 0.3% | NP10 (0.10%) | 2500 cp | 5.7 |
| 0.3% | NP10 (0.15%) | 2600 cp | 5.5 |
| 0.3% | NP7 (0.1%) | 2800 | 4.5 |
| 0.3% | NP13 (0.1%) | 2750 | 4.5 |
| 0.2% | NP40 (0.2%) | 2800 | 3.0 |

EXAMPLES 1-2

Preparation of Coal-aqueous mixtures

Coal-aqueous mixtures were prepared of the following compositions.

| Component (weight %) | EXAMPLES 1 | 2 | Viscosity | Shear Stability |
|---|---|---|---|---|
| COAL 1 | 70.0 | 70.0 | | |
| WATER | 29.4 | 29.3 | | |
| ANTIFOAM 2 | .1 | .1 | | |
| STABILIZER 3 | .1 | .1 | | |
| BIOCIDE 4 | .1 | .1 | | |
| NP100 5 | .3 | | 5700 cp | 0.5 hr |
| NP100 6 | | .4 | 3100 cp | 2.0 hr |

1. Elk Creek Coal
2. Foamaster R, Diamond Shamrock, Morristown, N.J.
3. Kelzan D, Kelco Div. of Merck & Co., Inc., San Diego, CA
4. Proxel CRL, ICI Americas, Wilmington, DE
5. IGEPAL CO 990, GAF Corp., New York, NY The coal was ground to about 75 percent finer than 200 mesh (Tyler) in a ring- roller mill (C. E. Raymond). The surfactant, antifoam, stabilizer and biocide were added to and dispersed in the water in a one-liter glass reactor which is immersed in a constant temperature bath held at ambient temperature, about 23° C. The coal was added to the mixture and was dispersed at 1800 rpm using a four-blade, 58 mm diameter impeller attached to the shaft of a model 6T60-10 motor (G. K. Heller Company, Las Vegas, NV).

The mixture containing 0.3% NP100 was seen to reach a minimum viscosity, as measured with the Brookfield "D" spindle at 30 rpm, of 5700 cp after 20 minutes of continuous stirring. The mixture contains the entire 70% of coal and is free flowing. After one-half hour of continuous stirring, the mixture had lost its free flowing property, and its viscosity was too high for measurement with the brookfield "D" spindle.

The mixture containing 0.4% NP100 reached a minimum viscsity of 3100 cp ("D" spindle, 30 rpm) and did not lose its free flowing property until two hours of continuous mixing.

EXAMPLES 3-9

These examples illustrate the unexpected improvement in flow properties and shear stability incorporated into coal-aqueous mixtures when low molecular weight surfactants are blended with NP100. Mixtures were prepared as in Examples 1-2.

| Component (weight %) | Examples 3 | 4 | 5 | 6 | 7 | 8 | 9 | HLB | MOL. WT. | Ethyleneoxide repeat units |
|---|---|---|---|---|---|---|---|---|---|---|
| Coal 1 | 70.0 | 70.0 | 70.0 | 70.0 | 70.0 | 70.0 | 70.0 | | | |

-continued

| Component (weight %) | Examples 3 | 4 | 5 | 6 | 7 | 8 | 9 | HLB | MOL. WT. | Ethyleneoxide repeat units |
|---|---|---|---|---|---|---|---|---|---|---|
| Water | 29.3 | 29.3 | 29.3 | 29.3 | 29.3 | 29.3 | 29.3 | | | |
| Stabilizer 2 | 0.1 | 0.1 | 0.1 | 0.1 | 0.1 | 0.1 | 0.1 | | | |
| Antifoam 3 | 0.1 | 0.1 | 0.1 | 0.1 | 0.1 | 0.1 | 0.1 | | | |
| Biocide 4 | 0.1 | 0.1 | 0.1 | 0.1 | 0.1 | 0.1 | 0.1 | | | |
| NP100 5 | 0.3 | 0.3 | 0.3 | 0.3 | 0.3 | 0.3 | 0.2 | 19.0 | 4680 | 100 |
| NP7 6 | 0.1 | — | — | — | — | — | — | 11.7 | 528 | 7 |
| NP10 7 | — | 0.05 | 0.10 | 0.15 | — | — | — | 13.2 | 682 | 10 |
| NP13 8 | — | — | — | — | 0.1 | — | — | 14.4 | 792 | 13 |
| NP40 9 | — | — | — | — | — | 0.1 | 0.2 | 17.8 | 1980 | 40 |
| Minimum Viscosity | 2800 cp | | 3500 | 2500 | 2600 | 2750 | 2600 | 2800 | | |
| Shear Stability | 4.5 Hrs. | | 1.5 | 5.7 | 5.5 | 4.5 | 3.0 | 3.0 | | |

1 Elk Creek Coal
2 Kelzan D
3 Foamaster R.
4 Proxel
5 IGEPAL C0990, GAF CORP.
6 Tergitol NP-10, Union Carbide, New York, NY
7 IGEPAL CO660, GAF Corp.
8 Tergitol NP-13, Union Carbide, New York, NY
9 Tergitol NP-40, Union Carbide, New York, NY The examples illustrate that at a total surfactant concentration of about 0.4%, the mixtures prepared from blended NP100 and low molecular weight surfactant, surprisingly exhibit a lower viscosity and greater stability to shear than a mixture prepared using 0.4% NP100 as the only surfactant present. The examples further show the unexpected result that the lowest viscosity and greatest shear stability occur when the low molecular weight surfactant is NP10. Still further, the examples demonstrate that, at 0.3% NP100, the lowest viscosity and greatest shear stability with NP10 as the low molecular weight species, occur at 0.1% NP10 loading. It will be appreciated by one skilled in the art that with different coals and different particle size distributions of a coal, that the optimum molecular weight and amount of the lower molecular weight surfactant will vary.

It is expected that because, as the molecular weight of the higher molecular weight surfactant increases, there will be less and less lower molecular weight fraction present in the natural distribution, therefore, the effectiveness of surfactants having a hydrophilic portion with up to about 150 or more ethylene oxide units should be improved by addition of a lower molecular weight surfactant in accordance with the present invention.

What is claimed is:

1. A coal-aqueous slurry consisting essentially of: particulate coal; water, a first surfactant having a hydrophilic portion comprising between about 40 and 150 ethylene oxide units; and a second surfactant having a hydrophilic portion comprising between about 4 and 40 ethylene oxide units, said first and second surfactants being present in the coal-aqueous slurry in amounts sufficient to disperse the particulate coal in the water and said first surfactant having a large number of ethylene oxide units relative to said second surfactant.

2. The coal-aqueous slurry as defined in claim 1 wherein the particulate coal is present in an amount from about 50 percent to about 80 percent by weight of the coal-aqueous slurry and the water is present in an amount from about 49.3 percent to about 19.3 percent by weight of the coal-aqueous slurry.

3. The coal-aqueous slurry as defined in claim 2 wherein the first surfactant is present in an amount from about 0.1 percent to about 3.0 percent by weight of the coal-aqueous slurry and the second surfactant is present in an amount from about 0.01 percent to about 1.5 percent by weight of the coal-aqueous slurry.

4. The coal-aqueous slurry as defined in claim 1 wherein the first and the second surfactants comprise polyalkylenoxide nonionic surfactants.

5. The coal-aqueous slurry as defined in claim 1 wherein the first surfactant hydrophilic portion comprises about 100 units of ethylene oxide and the second surfactant hydrophilic portion comprises about 10 units of ethylene oxide.

6. The coal-aqueous slurry as defined in claim 4 wherein the first surfactant has a molecular weight of about 4680, and the second surfactant has a molecular weight of about 682.

7. The coal-aqueous slurry as defined in claim 1 further containing a stabilizer.

8. The coal-aqueous slurry as defined in claim 7 wherein said stabilizer is selected from the groups consisting of xanthan gum, guar gum, cellulose gum and glue.

9. The coal-aqueous slurry as defined in claim 3 wherein the stabilizer comprises about 0.01 to 0.2 percent by weight of the coal-aqueous slurry.

10. The coal-aqueous slurry as defined in claim 1 further containing an antifoaming agent.

11. The coal-aqueous slurry as defined in claim 10 wherein the antifoaming agent comprises about 0.01 to 0.5 percent by weight of the coal-aqueous slurry.

12. A coal-aqueous slurry consisting essentially of: particulate coal comprising about 70 percent by weight of the total coal-aqueous slurry; water comprising about 30 percent by weight of the coal-aqueous slurry; a first nonylphenoxy polyoxyethleneoxide surfactant having a hydrophobic portion and a hydrophilic portion comprising about 100 ethylene units, said first nonylphenoxy polyoxyethlene surfactant comprising about 0.3 percent by weight of the coal-aqueous slurry; and a second nonylphenoxy polyoxyethlene surfactant having a hydrophobic portion and a hydrophilic portion comprising about 10 ethylene oxide units, said second nonylphenoxy polyoxyethylene surfactant comprising about 0.1 percent by weight of the coal-aqueous slurry.

13. The coal-aqueous slurry as defined in claim 12 further containing a stabilizer.

14. The coal-aqueous slurry as defined in claim 13 wherein said stabilizer is selected from the groups consisting of xanthan gum, guar gum, cellulose gum and glue.

15. The coal-aqueous slurry as defined in claim 14 wherein the stabilizer comprises about 0.01 to 0.2 percent by weight of the coal-aqueous slurry.

16. The coal-aqueous slurry as defined in claim 15 further containing an antifoaming agent.

17. The coal-aqueous slurry as defined in claim 16 wherein the antifoaming agent comprises about 0.01 to 0.5 percent by weight of the coal-aqueous slurry.

18. A method for forming coal-aqueous mixtures comprising the steps of: admixing particulate coal with ingredients consisting essentially of water, a first surfactant having a hydrophilic portion comprising between about 40 and 150 ethylene oxide units, and a second surfactant having a hydrophilic portion comprising between about 4 and 40 ethylene oxide units and said first surfactant having a large number of ethylene oxide units relative to said second surfactant.

19. The method of claim 18 wherein the particulate coal is added in an amount to cause the coal-aqueous slurry to comprise from about 50 percent to about 80 percent by weight particulate coal and the water is added in an amount to cause the coal-aqueous slurry to comprise from about 49.3 percent to about 19.3 percent by weight water.

20. The method of claim 19 wherein the first surfactant is added in an amount to cause the coal-aqueous slurry to comprise from about 0.1 percent to about 3.0 percent by weight. First surfactant and the second surfactant is added in an amount to cause the coal-aqueous slurry to comprise from about 0.01 percent to about 1.5 percent by weight second surfactant.

21. The method of claim 18 wherein the first and second surfactants are polyalkylenoxide nonionic surfactants.

22. The method of claim 18 wherein the first surfactant hydrophilic portion comprises about 100 units of ethylene oxide and the second surfactant hydrophilic portion comprises about 10 units of ethylene oxide.

23. The method of claim 21 wherein the first surfactant has a molecular weight of about 4680, and the second surfactant has a molecular weight of about 682.

24. The method of claim 18 wherein the first and second surfactants comprise a composition of the formula $$-R-O-(CH_2CH_2O)_n-CH_2-CH_2-OH$$

wherein R is substituted or unsubstituted alkyl of from 1 to 18 carbon atoms; substituted or unsubstituted aryl or an amino group and n for the first surfactant is a relatively high integer and n for the second surfactant is a relatively low integer.

25. The method of claim 24 wherein n for the first surfactant is an integer greater than about 40 and n for the second surfactant is an integer less that about 40.

26. The method of claim 24 wherein n for the first surfactant is an integer of about 100 and n for the second surfactant is an integer of about 10.

27. The coal-aqueous slurry as defined in claim 1 wherein the first and second surfactants comprise a composition of the formula $$R-O-(CH_2CH_2O)n-CH_2-CH_2-OH$$

wherein R is substituted or unsubstituted alkyl of from 1 to 18 carbon atoms; substituted or unsubstituted aryl or an amino group and n for the first surfactant is a relatively high integer and n for the second surfactant is a relatively low integer.

28. The coal-aqueous slurry as defined in claim 27 wherein n for the first surfactant is an integer greater than about 40 and n for the second surfactant is an integer less than about 40.

29. The coal-aqueous slurry as defined in claim 27 wherein n for the first surfactant is an integer of about 100 and n for the second surfactant is an integer of about 10.

* * * * *